US006297206B2

(12) United States Patent
Romack et al.

(10) Patent No.: US 6,297,206 B2
(45) Date of Patent: Oct. 2, 2001

(54) COMBINATION SURFACTANT SYSTEMS FOR USE IN CARBON DIOXIDE-BASED CLEANING FORMULATIONS

(75) Inventors: Timothy J. Romack; James P. DeYoung, both of Durham, NC (US)

(73) Assignee: MiCell Technologies, Inc., Raleigh, NC (US)

( * ) Notice: Subject to any disclaimer, the term of this patent is extended or adjusted under 35 U.S.C. 154(b) by 0 days.

(21) Appl. No.: 09/767,937

(22) Filed: Jan. 23, 2001

Related U.S. Application Data

(62) Division of application No. 09/313,748, filed on May 27, 1999, now Pat. No. 6,200,943

(60) Provisional application No. 60/087,018, filed on May 28, 1998.

(51) Int. Cl.[7] ..... D06L 1/00; D06L 1/02

(52) U.S. Cl. ..... 510/285; 510/286; 510/289; 510/290; 510/338; 510/342; 510/407; 510/432; 510/466; 8/142

(58) Field of Search ..... 510/285, 286, 510/289, 290, 338, 342, 407, 432, 466; 8/142

(56) References Cited

U.S. PATENT DOCUMENTS 5,676,705 * 10/1997 Jureller et al. ..... 8/142
5,683,473 * 11/1997 Jureller et al. ..... 8/142
5,683,977 * 11/1997 Jureller et al. ..... 510/286
5,789,505 * 8/1998 Wilkinson et al. ..... 526/209
5,858,022 * 1/1999 Romack et al. ..... 8/142
5,866,005 * 2/1999 DeSimone et al. ..... 210/634
5,977,045 * 11/1999 Murphy ..... 510/289
6,030,663 * 2/2000 McClain et al. ..... 427/389.9

* cited by examiner

*Primary Examiner*—Yogendra N. Gupta
*Assistant Examiner*—Charles Boyer
(74) *Attorney, Agent, or Firm*—Myers Bigel Sibley & Sajovec

(57) ABSTRACT

A method for dry-cleaning garments or fabrics in carbon dioxide comprises contacting a garment or fabric article to be cleaned with a liquid dry cleaning composition for a time sufficient to clean the article, said liquid dry-cleaning composition comprising a mixture of carbon dioxide, water, a first surfactant, and a second surfactant, and then separating the article from the liquid dry cleaning composition. The first surfactant comprises a $CO_2$-philic group covalently joined to a hydrophilic group; and the second surfactant comprising a $CO_2$-philic group covalently joined to a lipophilic group. In the alternative, a single surfactant containing all three of a $CO_2$-philic group, a lipophilic group, and a hydrophilic group covalently joined to one another may also be employed. Systems useful for carrying out the foregoing are also disclosed.

5 Claims, No Drawings

COMBINATION SURFACTANT SYSTEMS FOR USE IN CARBON DIOXIDE-BASED CLEANING FORMULATIONS

RELATED APPLICATIONS

This application is a divisional of U.S. application Ser. No. 09/313,748, now U.S. Pat. No. 6,200,943 entitled Combination Surfactant Systems for Use in Carbon Dioxide-Based Cleaning Formulations, filed on May 27, 1999, the disclosure of which is hereby incorporated herein in its entirety by reference.

This application claims priority from Provisional Application Ser. No. 60/087,018, filed May 28, 1998, the disclosures of which are incorporated by reference herein in their entirety.

1. Field of the Invention

The present invention relates to carbon dioxide-based cleaning formulations that contain surfactants and methods of using the same. The compositions and methods are particularly suitable for the cleaning of garments and fabrics.

2. Background of the Invention

Commercial dry cleaning systems currently employ potentially toxic and environmentally harmful halocarbon solvents, such as perchloroethylene. Carbon dioxide has been proposed as an alternative to such systems in U.S. Pat. No. 4,012,194 to Maffei. A problem with carbon dioxide is, however, its lower solvent power relative to ordinary solvents.

PCT Application WO 97/16264 by The University of North Carolina at Chapel Hill describes dry cleaning systems that employ liquid or supercritical carbon dioxide in combination with a surfactant that contains a "$CO_2$-philic" group. The term "$CO_2$-philic" was first coined in conjunction with such surfactants by J. DeSimone and colleagues. See, e.g., J. DeSimone et al., *Science* 265, 356–359 (Jul. 15, 1994).

PCT Application WO 96/27704 (Sep. 12, 1996) by Unilever, describes dry cleaning systems using densified carbon dioxide and special surfactant adjuncts. The term "densified carbon dioxide" means "carbon dioxide in a gas form which is placed under pressures exceeding about 700 psi at about 20° C." (pg. 5, lines 1–3). The surfactants employed have a supercritical fluid $CO_2$-philic moiety connected to a supercritical fluid $CO_2$-phobic moiety (pg 3, lines 30–32). In the method and apparatus described, a vertical rotating drum 5 (FIG. 1) containing soiled fabrics, surfactants, modifier, enzyme, peracid and mixtures thereof is charged with densified $CO_2$ fluid at a pressure ranging between 700 and 10,000 psi. The $CO_2$ is then heated to its supercritical range of about 20° C. to about 60° C. by a heat exchanger 4 (pg. 36 line 26 to pg. 37 line 8) and the cleaning cycle initiated. Other densified molecules that have supercritical properties, ranging from methane and ethane through n-heptane to sulfur hexafluoride and nitrous oxide, are noted that may also be employed in the described process, alone or in mixture with $CO_2$ (pg. 6 lines 25–35). See also U.S. Pat. No. 5,683,473 to Jureller et al; U.S. Pat. No. 5,683,977 to Jureller et al.; U.S. Pat. No. 5,676,705 to Jureller et al.

U.S. Pat. No. 5,377,705 to Smith et al. describes a precision cleaning system in which a work piece is cleaned with a mixture of $CO_2$ and a co-solvent. Smith provides an entirely non-aqueous system, stating: "The system is also designed to replace aqueous or semi-aqueous based cleaning processes to eliminate the problems of moisture damage to parts and water disposal" (col. 4 line 68 to col. 5 line 3). Co-solvents that are listed include acetone and ISOPAR™ M (col. 8, lines 19–24). Use in dry cleaning is neither suggested nor disclosed. Indeed, since some water must be present in dry-cleaning, such use is contrary to this system.

In view of the foregoing, there is a continuing need for effective carbon dioxide-based dry cleaning systems.

SUMMARY OF THE INVENTION

A method for dry-cleaning garments or fabrics in carbon dioxide comprises contacting a garment or fabric article to be cleaned with a liquid dry cleaning composition for a time sufficient to clean the article, said liquid dry-cleaning composition comprising a mixture of carbon dioxide, water, a first surfactant, and a second surfactant, and then separating the article from the liquid dry cleaning composition. the first surfactant comprises a $CO_2$-philic group covalently joined to a hydrophilic group; and the second surfactant comprising a $CO_2$-philic group covalently joined to a lipophilic group. Preferably at least one, and most preferably both, $CO_2$-philic groups are siloxane containing groups such as polydimethylsiloxane.

In a $CO_2$ based cleaning environment, the combination of a $CO_2$-philic/hydrophilic surfactant and a $CO_2$-philic/lipophilic surfactant provides distinct advantages over either independently. This is in contrast to situations employing an aqueous (hydrophilic) or oil (lipophilic) solvent system since in either of the latter two instances, there is a favorable interaction between the hydrophilic or lipophilic characteristics of the soil to be removed and entrained in the solvent system employed. Since $CO_2$ is neither hydrophilic nor lipophilic, this is not the case in a $CO_2$-based solvent system, thus a surfactant combination that encompasses both the $CO_2$-philic/hydrophilic and $CO_2$-philic/lipophilic components is advantageous. Note that this also extends to a single surfactant molecule that combines all three components ($CO_2$-philic, lipophilic, and hydrophilic groups).

DETAILED DESCRIPTION OF THE INVENTION

The term "clean" as used herein refers to any removal of soil, dirt, grime, or other unwanted material, whether partial or complete. The invention may be used to clean nonpolar stains (i.e., those which are at least partially made by nonpolar organic compounds such as oily soils, sebum and the like), polar stains (i.e., hydrophilic stains such as grape juice, coffee and tea stains), compound hydrophobic stains (i.e., stains from materials such as lipstick and candle wax), and particulare soils (i.e., soils containing insoluble solid components such as silicates, carbon black, etc.).

Articles that can be cleaned by the method of the present invention are, in general, garments and fabrics (including woven and non-woven) formed from materials such as cotton, wool, silk, leather, rayon, polyester, acetate, fiberglass, furs, etc., formed into items such as clothing, work gloves, rags, leather goods (e.g., handbags and brief cases), etc.

The invention can be employed with any carbon-dioxide dry cleaning system, such as described in U.S. Pat. No. 5,683,473 to Jureller et al; U.S. Pat. No. 5,683,977 to Jureller et al.; U.S. Pat. No. 5,676,705 to Jureller et al; and U.S. Pat. No. 4,012,194 to Maffei, the disclosures of which applicants specifically intend to be incorporated herein by reference. Of course, all such systems must be modified to incorporate the combination of surfactants described herein.

In one particular embodiment, Liquid dry-cleaning compositions useful for carrying out the present invention typically comprise:

(a) from 0.1 to 10 percent (more preferably from 0.1 to 4 percent) water;

(b) carbon dioxide (to balance; typically at least 30 percent);

(c) first surfactant (preferably from 0.1 or 0.5 percent to 5 or 10 percent); and (d) second surfactant (preferably from 0.1 or 0.5 percent to 5 or 10 percent); and (e) from zero or 0.1 to 50 percent (and in one embodiment from 4 to 30 percent) of an organic co-solvent. Percentages herein are expressed as percentages by weight unless otherwise indicated.

In another particular embodiment, a liquid dry-cleaning compositions useful for carrying out the present invention comprises:

(a) from 0.1 to 10 percent (more preferably from 0.1 to 4 percent) water;

(b) carbon dioxide (to balance; typically at least 30 percent);

(c) surfactant (preferably from 0.1 or 0.5 percent to 5 or 10 percent) where the surfactant contains a $CO_2$-philic group or segment, a lipophilic group or segment, and a hydrophilic group or segment covalently joined to one another, directly or indirectly (i.e., joined through the other segment), in a single molecule; and (d) from zero or 0.1 to 50 percent (and in one embodiment from 4 to 30 percent) of an organic co-solvent.

The compositions are provided in liquid form at ambient, or room, temperature, which will generally be between zero and 50° Centigrade. The composition is held at a pressure that maintains it in liquid form within the specified temperature range. The cleaning step is preferably carried out with the composition at ambient temperature.

The organic co-solvent is, in general, a hydrocarbon co-solvent. Typically the co-solvent is an alkane co-solvent, with $C_{10}$ to $C_{20}$ linear, branched, and cyclic alkanes, and mixtures thereof (preferably saturated) currently preferred. The organic co-solvent preferably has a flash point above 140° F., and more preferably has a flash point above 170° F. The organic co-solvent may be a mixture of compounds, such as mixtures of alkanes as given above, or mixtures of one or more alkanes in combination with additional compounds such as one or more alcohols (e.g., from 0 or 0.1 to 5% of a C1 to C15 alcohol (including diols, triols, etc.)).

As noted above, numerous surfactants can be employed in combination with the surfactants of the invention, including surfactants that contain a $CO_2$-philic group (such as described in U.S. Pat. No. 5,683,473 to Jureller et al; U.S. Pat. No. 5,683,977 to Jureller et al.; U.S. Pat. No. 5,676,705 to Jureller et al., the disclosures of which are incorporated by reference) linked to a $CO_2$-phobic group (e.g., a hydrophobic (typically lipophilic) group or a hydrophilic group) and surfactants that do not contain a $CO_2$-philic group (i.e., surfactants that comprise a hydrophilic group linked to a hydrophobic (typically lipophilic) group).

Examples of $CO_2$-philic groups include fluorine-containing groups or segments or siloxane-containing groups or segments. The fluorine-containing segment is typically a "fluoropolymer." As used herein, a "fluoropolymer has its conventional meaning in the art and should also be understood to include low molecular weight oligomers, i.e., those that have a degree of polymerization greater than or equal to two. See generally Banks et al., Organofluorine Compounds: Principals and Applications (1994); see also Fluorine-containing Polymers, 7 Encyclopedia of Polymer Science and Engineering 256 (H. Mark et al. Eds. 2d Ed. 1985). Exemplary fluoropolymers are formed from monomers which may include fluoroacryoate monomers such as 2-(N-ethylperflourooctanesulfonamido) ethyl acrylate, 2-(N-ethylperfluorooctanesulfonamido) ethyl methacrylate, 2-(N-methylperfluorooctanesulfonamido) ethyl acrylate, 2-(N-6 methylperfluorooctanesulfonamido) ethyl methacrylate, 1,1'-dihydroperfluorooctyl acrylate, 1,1'-dihydroperfluorooctyl methacrylate, 1,1',2,2'tetrahydroperfluoroalkylacrylate, 1,1'2,2'-tetrahydroperfluoroalkylmethacrylate and other fluoromethacrylates; fluorostyrene monomers such as alpha-fluorostyrene and 2,4,6-trifluoromethylstnrene; fluoroalkylene oxide monomers such as hexafluoropropylene oxide and perfluorocyclohexane oxide, fluoroolefins such as tetrafluoroethylene, vinylidine fluoride, and chlorotrifluoroethylene; and fluorinated alkyl vinyl ether monomers such as perfluoro(propyl vinyl ether) and perfluoro(methyl vinyl ether). Copolymers using the above monomers may also be employed. Exemplary siloxane segments include alkyl, fluoroalkyl, and chloralkyl siloxanes such as dimethylsiloxane and polydimethylsiloxane materials. Mixtures of any of the above may be used. Siloxane segments are currently preferred.

Examples of hydrophilic groups include, but are not limited to, ethylene glycol, polyethylene glycol, alcohols, alkanolamides, alkanolamines, alkylaryl sulfonates, alkylaryl sulfonic acids, alkylaryl phosphates, alkylphenol ethoxylates, betaines, quaternary amines, sulfates, carbonates, carbonic acids, etc.

Examples of lipophilic groups include, but are not limited to, linear, branched, and cyclic alkanes, mono and polycyclic aromatic compounds, alkyl substituted aromatic compounds, polypropylene glycol, polypropylene aliphatic and aromatic ethers, fatty acid esters, lanolin, lecithin, lignin derivatives, etc.

One particularly preferred group of surfactants is the "end functional" Polydimethylsiloxane (PDMS) materials, that have specific utility as surfactants in the formulation of $CO_2$ based cleaning systems. Detergency in non-aqueous cleaning systems is facilitated by surfactants that increase the quantity and stability of entrained water in the system. End Functional PDMS materials are differentiated from other functional PDMS materials by the locale and orientation of the functional group (e.g., hydrophilic or lipophilic functional groups; preferably hydrophilic functional groups) being at either (or both) termini of the molecules. The term "termini" or "terminus" herein refers to the discontinuation or end of dimethyl siloxane repeat units in the molecule. Thus the functional group is typically covalently joined to a dimethyl silyl group, rather than emanating from a methyl siloxane linkage in the backbone of the polymer.

In general, the PDMS materials contain multiple dimethyl siloxane repeat units that are "$CO_2$-philic", and functional groups generally considered as liophilic or hydrophilic (e.g., polar segments capable of forming strong hydrogen bonding interactions with water). As noted above, one end functional group on the PDMS molecule can be a lipophilic group, and the other end functional group on the PDMS molecule can be a hydrophilic group, with the liophilic and hydrophilic groups described above preferred.

PDMS reactive materials that can be used as precursors for end functional PDMS surfactants are silicones with reactive groups that upon reaction with a given substrate yield end functional materials. Reactive groups include but are not limited to, vinyl, hydride, silanol, alkoxy/polmeric alkoxide, amine, epoxy, carbinol, methacrylate/acrylate, mercapto, and acetoxy/chlorine/dimethylamine moieties. The PDMS material can be a mixture of molecules that contain either or both of the lipophilic and hydrophilic end functional groups.

An example of an end fuctional PDMS material is 3-([2-hydroxy-3-diethylamino]propoxy) propyl terminated polydimethylsiloxane. The material has a number average molecular weight of about 200 to 50,000 g/mole, preferably about 1200 g/mole.

Conventional surfactants may also be used in combination with the foregoing. Numerous surfactants are known to those skilled in the art. See, e.g., McCutcheon's Volume 1: Emulsifiers & Detergents (1995 North American Edition) (MC Publishing Co., 175 Rock Road, Glen Rock, N.J. 07452). Examples of the major surfactant types that can be used to carry out the present invention include the: alcohols, alkanolamides, alkanolamines, alkylaryl sulfonates, alkylaryl sulfonic acids, alkylbenzenes, amine acetates, amine oxides, amines, sulfonated amines and amides, betaine derivatives, block polymers, carboxylated alcohol or alkylphenol ethoxylates, carboxylic acids and fatty acids, diphenyl sulfonate derivatives, ethoxylated alcohols, alkylphenols, ethoxylated amines and/or amides, ethoxylated fatty acids, ethoxylated fatty esters and oils, fatty esters, fluorocarbon-based surfactants, glycerol esters, glycol esters, hetocyclic-type products, imidazolines and imidazoline derivatives, isethionates, lanolin-based derivatives, lecithin and lecithin derivatives, lignin and lignin deriviatives, maleic or succinic anhydrides, methyl esters, monoglycerides and derivatives, olefin sulfonates, phosphate esters, phosphorous organic derivatives, polyethylene glycols, polymeric (polysaccharides, acrylic acid, and acrylamide) surfactants, propoxylated and ethoxylated fatty acids alcohols or alkyl phenols, protein-based surfactants, quaternary surfactants, sarcosine derivatives, silicone-based surfactants, soaps, sorbitan derivatives, sucrose and glucose esters and derivatives, sulfates and sulfonates of oils and fatty acids, sulfates and sulfonates ethoxylated alkylphenols, sulfates of alcohols, sulfates of ethoxylated alcohols, sulfates of fatty esters, sulfonates of benzene, cumene, toluene and xylene, sulfonates of condensed naphthalenes, sulfonates of dodecyl and tridecylbenzenes, sulfonates of naphthalene and alkyl naphthalene, sulfonates of petroleum, sulfosuccinamates, sulfosuccinates and derivatives, taurates, thio and mercapto derivatives, tridecyl and dodecyl benzene sulfonic acids, etc.

As will be apparent to those skilled in the art, numerous additional ingredients can be included in the dry-cleaning composition, including detergents, bleaches, whiteners, softeners, sizing, starches, enzymes, hydrogen peroxide or a source of hydrogen peroxide, fragrances, etc.

In practice, in a preferred embodiment of the invention, an article to be cleaned and a liquid dry cleaning composition as given above are combined in a closed drum. The liquid dry cleaning composition is preferably provided in an amount so that the closed drum contains both a liquid phase and a vapor phase (that is, so that the drum is not completely filled with the article and the liquid composition). The article is then agitated in the drum, preferably so that the article contacts both the liquid dry cleaning composition and the vapor phase, with the agitation carried out for a time sufficient to clean the fabric. The cleaned article is then removed from the drum. The article may optionally be rinsed (for example, by removing the composition from the drum, adding a rinse solution such as liquid $CO_2$ (with or without additional ingredients such as water, co-solvent, etc.) to the drum, agitating the article in the rinse solution, removing the rinse solution, and repeating as desired), after the agitating step and before it is removed from the drum. The dry cleaning compositions and the rinse solutions may be removed by any suitable means, including both draining and venting.

Any suitable cleaning apparatus may be employed, including both horizontal drum and vertical drum apparatus. When the drum is a horizontal drum, the agitating step is carried out by simply rotating the drum. When the drum is a vertical drum it typically has an agitator positioned therein, and the agitating step is carried out by moving (e.g., rotating or oscillating) the agitator within the drum. A vapor phase may be provided by imparting sufficient shear forces within the drum to produce cavitation in the liquid dry-cleaning composition. Finally, in an alternate embodiment of the invention, agitation may be imparted by means of jet agitation as described in U.S. Pat. No. 5,467,492 to Chao et al., the disclosure of which is incorporated herein by reference. As noted above, the liquid dry cleaning composition is preferably an ambient temperature composition, and the agitating step is preferably carried out at ambient temperature, without the need for associating a heating element with the cleaning apparatus.

EXAMPLE 1

3-([2-hydroxy-3-diethylamino]propoxy) propyl terminated polydimethylsiloxane is synthesized as follows. Starting with epoxypropoxypropyl terminated polydimethylsiloxane with an average molecular weight range of 900–1100 g/mole, the siloxane and a 5 molar excess of diethyl amine are added to a round bottom flask equipped with a reflux condenser. A heating bath is applied to the round bottom flask with a bath temperature of about 78° C. and the mixture is refluxed under a static argon head pressure for about 48 hours. The product is isolated by distilling the excess diethyl amine from the polymer and exposing the polymer to a vacuum <1 mm Hg for 12 hours.

EXAMPLE 2

A polydimethylsiloxane surfactant with both a hydrophilic and lipophilic moiety is prepared as follows. Starting with a hydride terminated polydimethylsiloxane with a molecular weight of 400–500 g/mol, 3-allyloxy-1,2-propane diol, and allyl hexadecyl ether: Equimolar amounts of the 3-allyloxy-1,2-propane diol, and allyl hexadecyl ether are added to a round bottom flask and diluted with 2 volumetric equivalents of dry toluene. A stoichiometric equivalent of the hydride terminated siloxane is added to the flask, along with a catalytic amount of chloroplatinic acid, which is capped with a reflux condenser and placed under a static head pressure of argon. The flask is then placed in a hot oil bath and the mixture is stirred at about 90° C. for about 36 hours. After completion of the reaction the product consists of a statistical mixture of molecules with an average of 1 propoxypropane diol end group and 1 propoxy hexadecyl end group.

The foregoing is illustrative of the present invention, and is not to be construed as limiting thereof. The invention is defined by the following claims, with equivalents of the claims to be included therein.

That which is claimed is:

1. A method for dry-cleaning garments or fabrics in carbon dioxide, comprising:

contacting a garment or fabric article to be cleaned with a liquid dry cleaning composition for a time sufficient to clean the article, said liquid dry-cleaning composition comprising a mixture of carbon dioxide, water, and a surfactant;

said surfactant comprising a $CO_2$-philic group, a hydrophilic group, and a lipophilic group covalently joined to one another; then separating the article from the liquid dry cleaning composition.

2. A method according to claim 1, wherein said liquid dry cleaning composition is at a temperature of 0° C. to 30° C.

3. A method according to claim 1, said composition further comprising an organic co-solvent.

4. A liquid dry-cleaning composition, said composition comprising:

(a) from 0.1 to 10 percent water;

(b) carbon dioxide;

(c) from 0.1 to 10 percent of a surfactant, wherein said surfactant comprises a CO2-philic group, a hydrophilic group, and a lipophilic group covalently joined to one another; and (e) from zero to 50 percent of an organic co-solvent.

5. A liquid dry-cleaning composition according to claim 4, said composition comprising:

(a) from 0.1 to 4 percent water;

(b) carbon dioxide;

(c) from 0.5 to 5 percent of said surfactant; and (d) from 4 to 30 percent of an organic co-solvent.

* * * * *